United States Patent [19]

Curran

[11] Patent Number: 4,516,717

[45] Date of Patent: May 14, 1985

[54] CONTAINER DIVIDER

[76] Inventor: John J. Curran, 4470 Granville St., Vancouver, British Columbia, Canada, V6M 3L8

[21] Appl. No.: 550,964

[22] Filed: Nov. 14, 1983

[30] Foreign Application Priority Data

Nov. 25, 1982 [CA] Canada ..... 416410

[51] Int. Cl.[3] ..... B65O 5/48

[52] U.S. Cl. ..... 229/15; 229/27; 229/42; 229/DIG. 9

[58] Field of Search ..... 229/15, 27, 42, 29 R, 229/29 E, 29 F, 28 R, 28 BC, DIG. 9; 217/7, 8, 22; 53/539, 243, 443, 457

[56] References Cited

U.S. PATENT DOCUMENTS

| | | | |
|---|---|---|---|
| 1,995,482 | 3/1935 | Plautz | 229/15 X |
| 2,640,589 | 6/1953 | Foster et al. | 229/15 X |
| 2,688,396 | 9/1954 | Fryburger | 229/DIG. 9 |
| 2,795,365 | 6/1957 | Currie | 229/DIG. 9 |
| 3,626,494 | 12/1971 | Levin | 229/15 |
| 3,980,223 | 9/1976 | Curran | 229/15 X |
| 4,089,457 | 5/1978 | Wood et al. | 229/15 |
| 4,330,078 | 5/1982 | Graser | 229/42 X |
| 4,417,684 | 11/1983 | Skaggs | 229/27 X |

FOREIGN PATENT DOCUMENTS

| | | | |
|---|---|---|---|
| 271709 | 12/1966 | Australia | 229/28 R |
| 672989 | 10/1963 | Canada | 229/15 |
| 715401 | 8/1965 | Canada | 229/15 |

*Primary Examiner*—William Price
*Assistant Examiner*—Gary E. Elkins
*Attorney, Agent, or Firm*—Spensley Horn Jubas & Lubitz

[57] ABSTRACT

A container divider for separating bottles in a box or the like, is provided. The divider has a number of panels, cross members, and extensions of some of the foregoing, so that the divider can be cut from a single unitary sheet of material and placed and retained in an erected position without the use of glue. In one embodiment of the divider, a tab is hingedly connected to the remainder of the divider so that the remainder of the divider can be positioned in an upper end of a box and later in a lower end of it, when the bottles in the box are in an inverted and upright position respectively.

9 Claims, 10 Drawing Figures

CONTAINER DIVIDER

BACKGROUND OF THE INVENTION

This invention relates to a container divider for use in boxes, cartons, or the like so as to separate articles, such as bottles, from each other within the carton.

DESCRIPTION OF THE PRIOR ART

Various types of dividers for separating bottles or the like in a box or carton, are well known. One type of well known divider is typically made to separate one dozen bottles, and consists of two parallel side panels between them having three opposed pair of slots, and three cross members each having two slots meeting with the slots of the side panels. The difficulty with such a structure is that not only is it wasteful of material (usually cardboard), but it also requires a time consuming, relatively difficult, manual assembly of the sides and cross members. Other dividers have been described which avoid manual assembly of components by cutting, usually by stamping, the divider into a unitary, single sheet of cardboard. The divider is cut so that the cross members and sides are swingable with respect to each other two positions corresponding to an erected position of the divider. Such dividers are disclosed in U.S. Pat. No. 4,226,357 to Martin. A difficulty with the first and third of the foregoing dividers is that they are wasteful of material. The problem associated with all of the foregoing dividers is that gluing of various sections is required in order to retain the dividers in an erected position. Gluing is particularly undesirable in view of the additional cost both for the glue and gluing step. In order to rapidly glue such previous structures, generally automated equipment is required. Another problem with dividers where gluing is required is that the manufacturer must either erect and glue them himself, which makes for obvious bulkiness in shipping, or the user must himself obtain the automated erecting and gluing equipment, which could be an economic strain on small concerns. This is so since bottle manufacturers generally ship their bottles one dozen to a box, to a user of the bottle who will then fill it. In shipping the bottles from the manufacturer, they are commonly shipped up-side-down so as to facilitate unloading at the user's plant. Thus, in the case of bottles with long necks narrower than the body (such as wine bottles or the like), when the bottles leave the manufacturers plant it is only necessary to have a divider at the upper end of the carton or box since this will ensure that the wider bases of the bottles cannot touch one another. However, when the same long neck bottles are filled and leave the user's plant (such as a winery), then it is only necessary to have a divider adjacent the bottom end of the box or carton. Generally, previous devices have been of a height equal to the height of the bottles which they are to separate, and where the bottles are long necked, such is obviously not essential, and wastes material. U.S. Pat. No. 4,226,357 to Martin does disclose a divider which is equal only in height to the bases of the bottles to be separated, and which can be positioned in an upper end of the box, or a lower end of it, as illustrated in FIGS. 9 and 10 respectively of that patent. The divider is retained in its respective upper end lower positions by means of tabs which extend through corresponding holes in the box. Such an arrangement is disadvantageous since it is then necessary to provide boxes with holes of the appropriate dimensions and at the appropriate heights. In addition, when the bottles are in an up-side-down position, any slight tilt of the box which may occur between handling can result in the weight of the bases of the bottles pressing against the side of the box into which the tabs are inserted and causing that side of the box to bend slightly. Even with such a slight bend of the box wall, one or both of the tabs could come out of its corresponding hole in the box wall, thereby resulting in the divider sliding to the bottom of the box with disastrous consequences for the bottles.

SUMMARY OF THE INVENTION

It is desirable then to provide a divider which can be formed from flat, unitary sheets in a single stamping operation, which can be readily erected by hand, which does not require any gluing, and which preferably has a means which allows it to be positioned and retained in an upper or lower end of a box as desired.

The present invention provides a container divider comprising a first side panel, a first end panel, a second side panel, and a second end panel. The panels are hingedly connected together end to end in the foregoing sequence, so as to be inwardly swingable about connected ends from coplanar positions when the divider is a flat position, to respective swung positions when the divider is in an erected position. When the divider is in an erected position, the foregoing panels define an enclosed quadrilateral with lengthwise remote ends of the first side panel and second side panel abutting one another. The container also has a cross member with an upstanding end hingedly connected to the first side so as to be inwardly swingable about the connected end from a position coplanar with the panels when the divider is in a flat position, to a swung position when the divider is in the erected position. When the cross member is in the swung position, an end of it abuts the second side panel.

Preferably, two pairs of tongue and mating recepticle combinations are additionally provided. The members of one pair extend from respective abutting portions of the first side and second end panels. The members of the other pair extend from respective abutting portions of the cross member and the second side panel. The two pairs are arranged to retain abutting portions in engagement when the divider is in the erected position.

Advantageously, the side panels are equal in length, and the end panels and the cross member are also equal in length. At the same time, the cross member is connected midway along the first side panel. In addition, each of the panels and the cross member when in respective swung positions, are orthogonal to respective connected panels.

Preferably, the side panels are twice the length of the end panels and the cross member.

In a preferred embodiment of the divider described, the divider additionally comprises a pair of cross member extensions which extend in coplanar relationship with the cross member from respective ends of it, each being equal in length to it. A pair of second end panel extensions are also provided which extend in coplanar relationship with the second end panel from respective ends of it, each being equal in length to it.

In another embodiment of the divider, the divider comprises two lengthwise aligned sections of the same dimensions, each basically constructed in the same manner as the divider previously described. The sections are connected with ends of the first side panels of the sections remote from connected first end panels, being connected together.

Advantageously, the divider last described additionally comprises a tab hingedly extending from a bottom of one of the second ends, so as to be inwardly swingable thereabout from a position coplanar therewith to a position orthogonal thereto. A method of producing a plurality of equally dimensioned dividers of the foregoing type is also provided. This method comprises cutting pairs of the dividers in a unitary sheet, with the members of each pair being cut in lengthwise inverted relationship, with the bottom edge of the tab on each one of the pair being substantially lengthwise aligned with a bottom edge of a second end panel of the other one of the pair and extending lengthwise therebeyond.

DESCRIPTION OF THE PREFERRED EMBODIMENT

Figure 1:
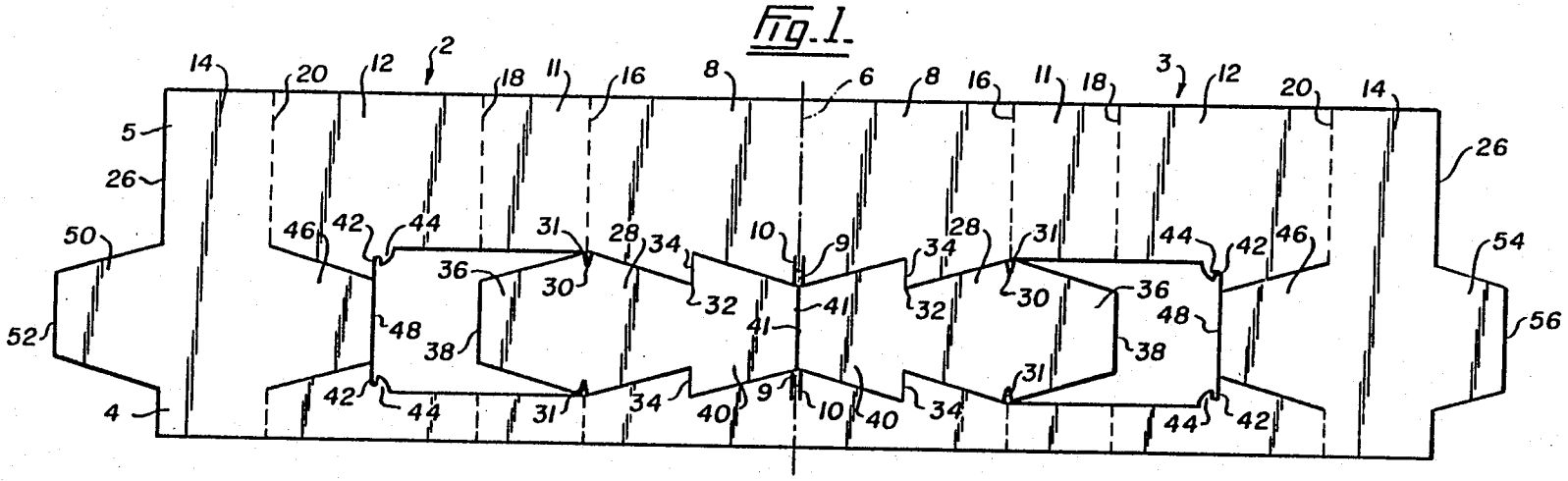
FIG. 1 is a side elevation view of a divider of the present invention in a flat position.

Referring first to the divider of FIGS. 1 to 4 it will be seen (particularly in FIG. 1) that the divider consists of two lengthwise aligned sections 2 and 3, each of the same dimensions, and being cut on a unitary sheet and connected along a mid line 6 of the divider. The divider has a bottom end 5 and top end 4. It should be noted at this point, that the heavy lines illustrate cut lines, whereas the lighter lines (for example those numbered 16 and 18), represent crease lines only.

Each of the sections 2, 3 has a first side panel 8, first end panel 11, second side panel 12, and second end panel 14. The foregoing panels are hingedly connected together end to end through respective straight crease lines 16, 18 and 20. It will be observed that the straight crease lines 16, 18, 20, as well as the mid lines 6, and edge 26 of panel 14, are not continuous. However, it is the distance between each adjacent pair of the foregoing lines which defines the length of the respective panels. It will be seen then that the end panels 11 and 14 are equal in length, and the side panels 8 and 12 are twice the length of the end panels 11 and 14. It will also be understood that the ends of any particular panel refer to those portions adjacent of the foregoing lines or the imaginary line which can be drawn between segments of each line.

Each of the sections 2 and 3 is also provided with a cross member 28 equal in length to the end panels 11 and 14. The cross member extends between one end 30 which is colinear with the crease line 16 when the divider is in the flat position, and another end 32. The end 32 is hingedly connected at crease line 34 mid way along the panel 8, that is mid way between mid line 6 and crease line 16. A pair of cross member extensions 36 and 40 are provided which extend from respective ends 30 and 32 of the cross member 28, and are unitary and coplanar with it and each equal in length to the cross member 28. Thus, the edge 38 of extension 36 is colinear with the crease line 18, while the edge 41 of the extension 40 is colinear with the mid-line of the divider, when the divider is in the flat position. The section 2 of the divider also has two second end panel extensions 46 and 50, each with respective edges 48 and 52, unitary and coplanar with the second end panel 14 and equal in length to it. The section 3 has one second end panel extension 46 only extending from one end of the second end panel 14, and partly defined by an edge 48. This is the only manner in which section 3 differs from section 2. Again on each section, there is provided as part of the second side 12, two flaps 44 arranged to define two slots 42 between them and the remainder of the second side 12. The slots 42 together act as a mating receptacle for a tongue which can be considered as a portion of the extension 36 and connected cross member 28 immediately adjacent the slots 31. The pair of slots 9 and scored flaps 10 together act as two adjacent pair of receptacles for receiving a mating tongue 54 of section 3, and a mating tongue of section 2 which may be regarded as a portion of the second end panel extension 50 immediately adjacent the second end panel 14.

Figure 2:
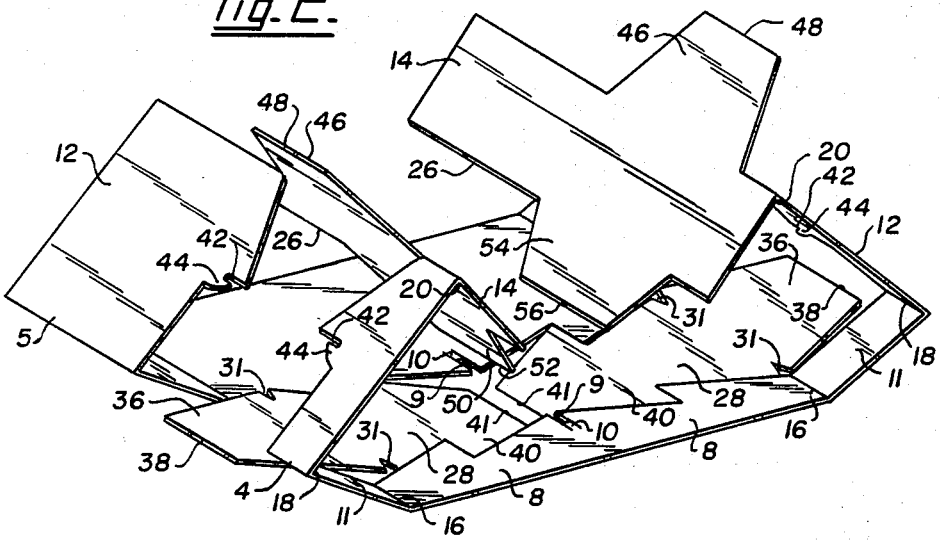
FIG. 2 is a perspective view toward the top of the divider of FIG. 1 when in a partially erected position.
Figure 3:
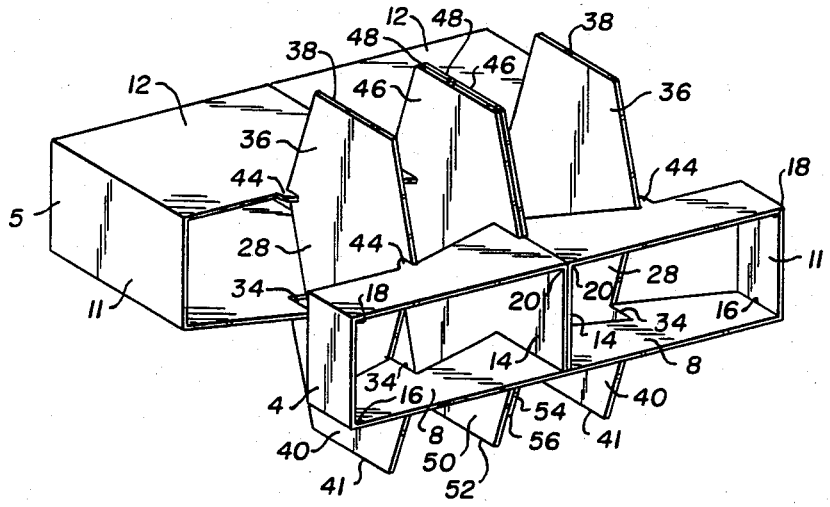
FIG. 3 is a perspective view towards the top of the divider of FIG. 1 when in an erected position.

Referring now to FIGS. 2 and 3, the manner of erection of the divider shown in FIG. 1 will become apparent. First, it should be noted that all of the panels and cross member 28 swing inwardly above their respective score lines, that is in a direction out of the page as shown in FIG. 1, and are thus swinging toward their score line thereby facilitating such swinging movement. One method of assembling the divider of FIG. 1 then, as shown in FIGS. 2 and 3 is to swing each of the panels 8, 11, 12, and 14 of each section, about its respective score line 16, 18 and 20 so that the tongue 54 on section 3, and second end panel extension 50 on section 2, are in a position to penetrate through slots 9, as shown in FIG. 2. At the same time, cross members 28 and attached extensions 36 and 40 on each section 2 and 3, can be swung inward about the score lines 34, again as shown most clearly in FIG. 2. The foregoing movements are continued until edges 26 of the second end panels 14 are abutting respective first side panels 8, with the tongue 54 lying adjacent the second end panel extension 50. The swinging movement of the cross member 28 and attached respective extensions 36 and 40 is also continued until the slits 31 are lying within the slots 42 of respective second sides 12, that is with the ends 30 of the cross members 28 abutting respective second sides 12. Such will be the erected position of the divider as shown in FIG. 3. Thus, when the divider is in the erected position of FIG. 3, each section 2 and 3 has two pairs of tongue and mating receptacle combinations, one of which retains abutting portions of the cross member 28 and second side 12 in engagement with one another, and another which retains abutting portions of the second end panel 14 and first side panel 8 in engagement with one another. It will be noted that abutting portions of each cross member 28 and second side panel 12, and second end panel 14 and first side panel 8, are still be referred to as such even when the divider is in the flat position shown in FIG. 1.

Figure 4:
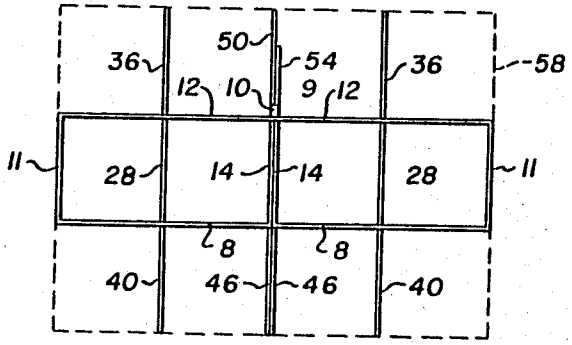
FIG. 4 is a top view of the divider of FIG. 1 in the erected position, illustrating its application in a box.

FIG. 4 illustrates how the divider shown in FIG. 3 in the erected position, can be utilized within a box 58 to define 12 compartments for long-necked bottles such as wine bottles. If it was desired to ship bottles in the up-side-down position in the box 58, it would be necessary to invert the erected divider shown in FIG. 3, so that the bottom end 4 is at the top of the box 58.

Figure 5:
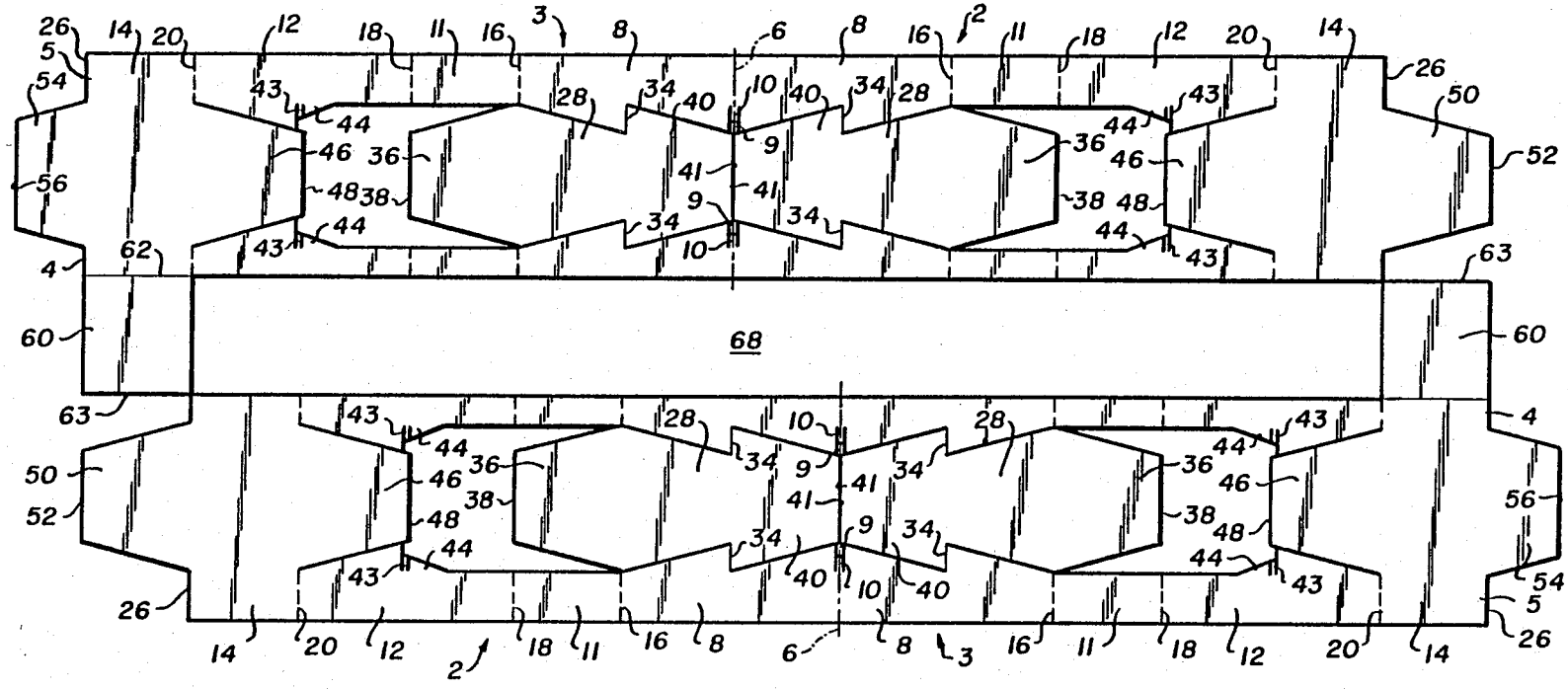
FIG. 5 is a side elevation view illustrating a method of cutting two dividers each being another embodiment of the present invention.

Referring now to FIG. 5, a unitary sheet is shown into which two dividers of another embodiment of the invention have been cut. As will be evident, each of the dividers shown in FIG. 5 is basically the same as that shown in FIGS. 1 to 4 with corresponding parts being numbered identically, and only differences shall be discussed. First, it will be noticed that each of the panels 8, 11, 12 and 14 of each section have a lower height than the panels of the divider in FIG. 1. In addition, the flaps 44 have been somewhat modified in shape with the slots 42 of the FIG. 1 embodiment being replaced by creased flaps 43. As creased flaps 43 are provided on each second side panel 12, slots 31 of the FIG. 1 embodiment are no longer required. However it will be appreciated that flaps 43 act as mating receptacles for tongues (again regarded as portions of the cross member 28 and extension 36 adjacent the end 30 of cross member 28) in a similar manner as the slots 42 did in the FIG. 1 embodiment. In addition, the embodiment of FIG. 5 is provided with a tab 60 hingedly extending from a bottom of a second end 14 of the Section 3 by means of score line 62. The tab 60 is swingable from a position shown in FIG. 5 coplanar with the second end panel 14, to a position orthogonal to it, the tab typically swinging inward toward the score line 62, although as will be apparent from the description to follow, the direction in which the tab 60 might swing is not particularly relevant. It will be noticed that the dividers shown in FIG. 5 are cut in a lengthwise inverted relationship, that is with the lower ends 4 facing each other. In addition, the bottom edge 63 of the tab 60 on each one of the pair of dividers shown in FIG. 5, is lengthwise aligned with a bottom edge of a second end panel 12 of the other one of the pair. As is illustrated by the heavy cut lines surrounding the rectangular section 68 of material, section 68 is wasted material. However, it will be observed that for each of the two panels shown in FIG. 5, there is only one rectangular section of material 68 (surrounded by heavy lines) which is wasted. If two of the panels of the type in FIG. 1 were cut from a single sheet instead, with their mid-lines 6 aligned, the amount of wasted material would then be almost twice the area of the rectangle 68.

Figure 6:
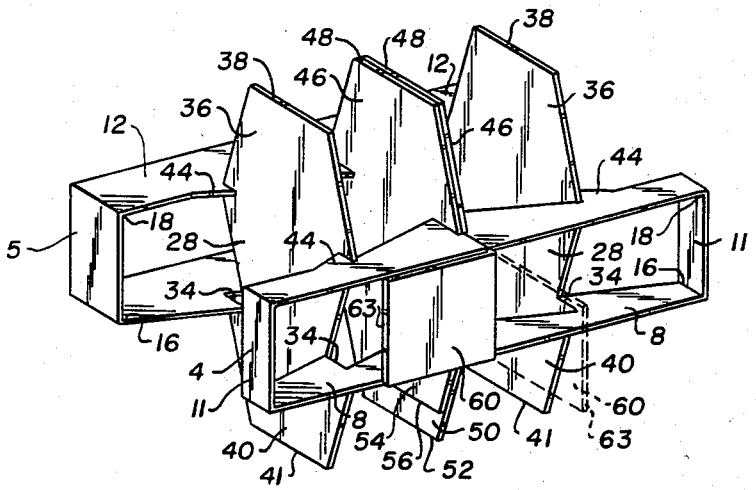
FIG. 6 is a perspective view of a divider of FIG. 5 in an erected position.

Each of the dividers shown in FIG. 5 are assembled in a similar manner as the divider of FIG. 1, an assembled divider of the type in FIG. 5 being shown in FIG. 6. It will be noted that the tab 60, because of its hinged connection to the second end panel 14 by means of the score line 62, will initially be positioned in coplanar relationship with its attached second end panel 14, in a manner shown in broken lines in FIG. 6, but can be swung to a position orthogonal to its connected second end panel 14 as shown in solid lines in FIG. 6. At this point it will be noticed that the particular direction in which the tab 60 shown swings is not really relevant, however it will tend to swing in the direction of its score line 62 as shown in FIG. 6.

Figure 7:
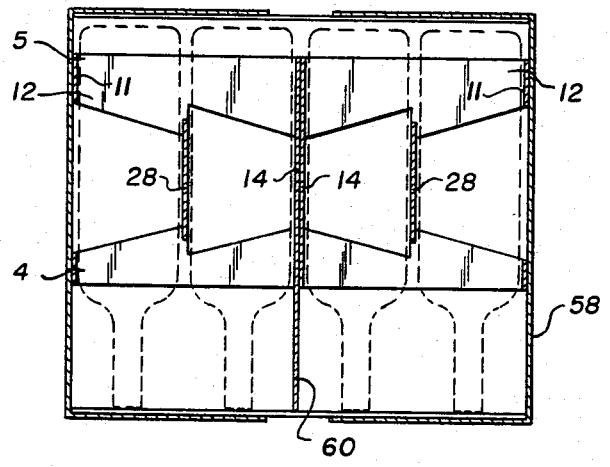
FIGS. 7 and 8 are vertical cross-sections illustrating use of a divider of FIG. 5.
Figure 8:
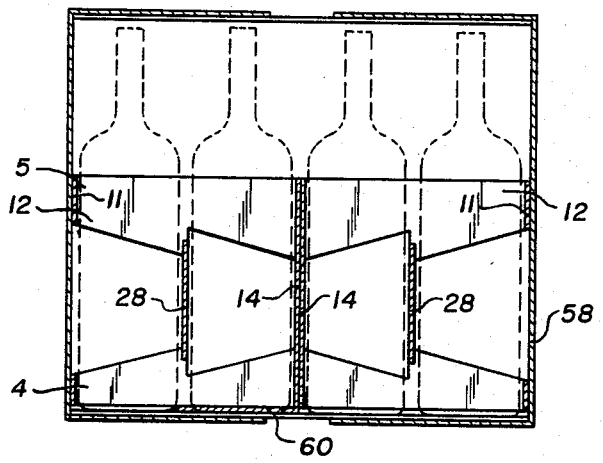

Each of the dividers of the type shown in FIG. 5, are used in the same manner as the divider of the embodiment of FIG. 1, with the exception that by leaving the tab 60 in the position shown in broken lines in FIG. 6, the remainder of the divider can be positioned in an upper end of the box containing bottles in a manner shown in FIG. 7. This is a position in which the bottles are shipped from a bottle manufacturer. A user of the bottles will generally simply swing the box 58 up-side-down so that the bottles are upright and remove the box 58 from the bottles. When the bottles are filled by the user, prior to their being placed back in the box 58, pressure is merely brought to bear on the top end 5 of the divider either by hand or mechanical means, so that the tab 60 will swing about its score line 62 when the divider is pushed to the bottom of the box 58 as shown in FIG. 8.

Figure 10:
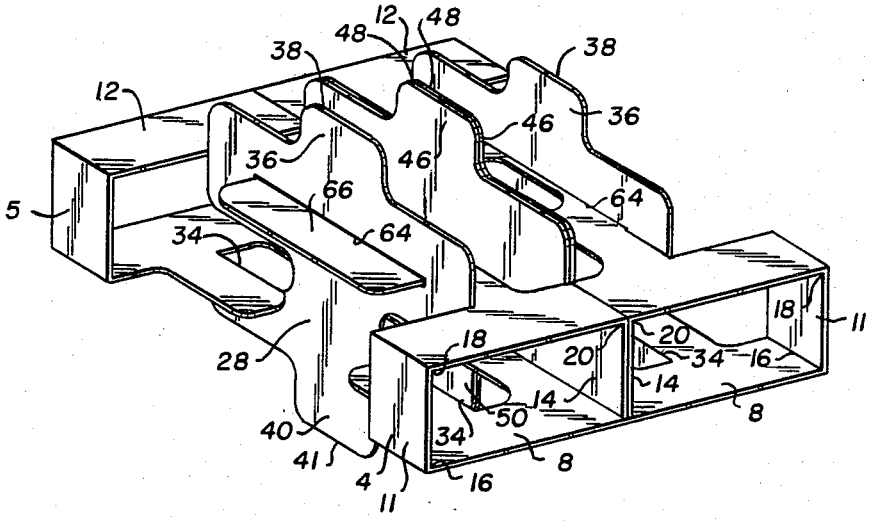
FIG. 10 is a perspective view of the divider of FIG. 9 in an erected position.
Figure 9:
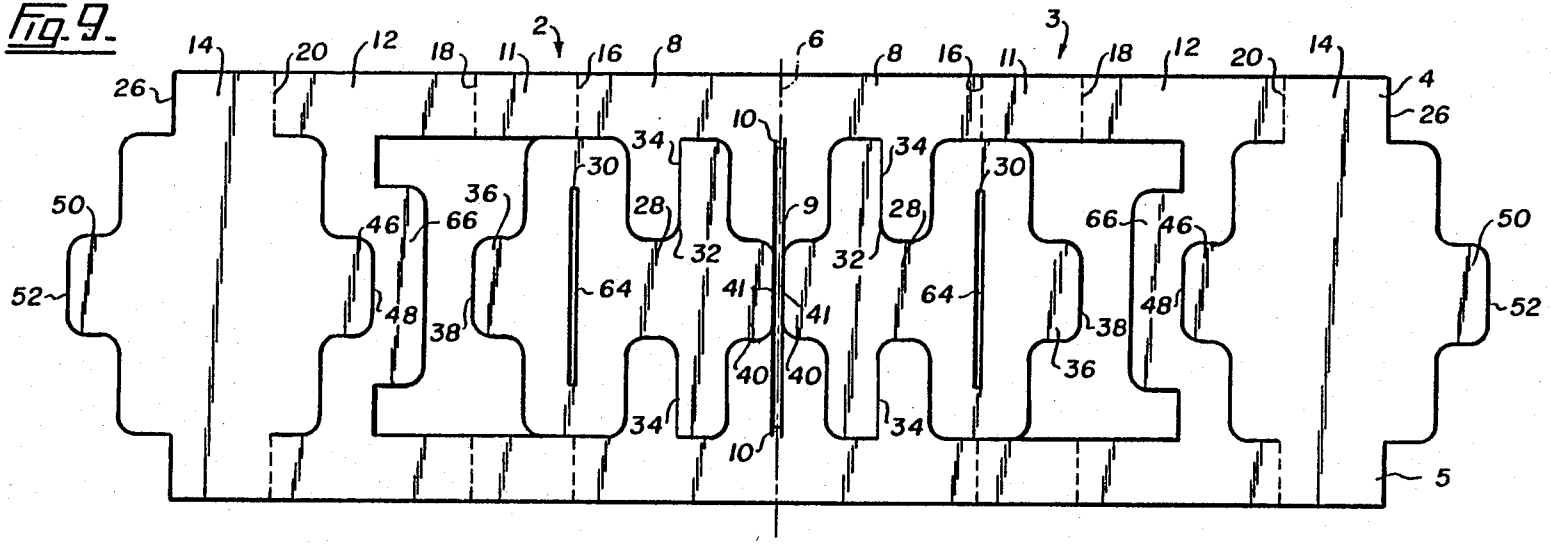
FIG. 9 is an elevation view of another embodiment of the divider of the present invention.

Referring now to FIG. 9, another embodiment of the divider of the present invention is shown. The divider shown in FIG. 9 is basically similar in construction to that of the divider in FIG. 1 and similar parts have been numbered the same, and only differences in construction will be discussed. First, it will be noted that the slot 9 is somewhat longer than the slot 9 of the embodiment of FIGS. 1 to 4. This is to accommodate the larger second end panel extensions 50, one each of which is connected to the second end panel 14 of each of the sections 2 and 3 (which it will be observed are identical in the embodiment of FIG. 9). Thus, only one section 2 will be specifically referred to. The cross member 28, rather than being provided with a tongue, is now provided with a receptacle 64 positioned between the cross member 28 and the cross member extension 36, and colinear with the crease line 16. The receptacle 64 snugly accommodates a tongue 66 connected to the second side panel 12. This accommodation is most clearly seen in FIG. 10 which illustrates the divider of FIG. 9 in the erected position viewed toward the top 5 of it. However, it will be appreciated that it makes no difference whether the end 5 serves as a top or bottom end, the divider of FIG. 9 and 10 being dimensioned such that its height is equal to the height of the bottles to be separated.

All of the dividers described above are most conveniently made of cardboard, and a plurality of them can be cut simultaneously from a single die on a flat unitary piece of such cardboard. When the word "cut" is used in such a manner, it is to be appreciated that such includes formation not only of the cut lines (the heavier lines in the drawing) but also formation of the crease lines (the lighter lines in the drawings).

Various modifications are of course possible to the dividers described above. For example, other tongue and receptacle combinations will be apparent to those skilled in the art, particularly when it is born in mind that cross members 28, cross member extensions 36 and 40, second end panel extensions 46 and 50, and tongue 54, need not be of the particular shape shown, it being possible to produce a vast array of shapes and sizes as desired. Other variations include using one section of the panel only as a divider for six bottles. In such a situation though, it would be preferable that a better receptacle that one half of slot 9 and portion 10 is provided. In fact, if one wished, by leaving out the cross member extensions and second end panel extensions, one would have a divider for separating only two bottles. Another variation includes replacing the tongue 54 with a second end panel extension 50 which again would also act as a tongue. The only disadvantage of such a variation is unnecessary use of material. One could also of course leave out a second end panel extension 46 on one of the sections, but there is little reason to do so since such material would only be wasted in any event and therefore might as well be used to produce additional strength in the erected divider.

As will be apparent to those skilled in the art in light of the foregoing disclosure, many further alterations and modifications are possible in the practice of this invention without departing from the spirit or scope thereof. Accordingly, the scope of the invention is to be construed in accordance with the substance defined by the following claims.

What is claimed is:

1. A container divider, comprising:

(a) a first side panel, a first end panel, a second side panel, and a second end panel, said panels being hingedly connected together end to end in the foregoing sequence so as to be inwardly swingable about connected ends from coplanar positions when the divider is in a flat position, to respective swung positions when the divider is in an erected position defining an enclosed quadrilateral with lengthwise remote ends of said first side and second end panels abutting one another;

(b) a cross member with an upstanding end hingedly connected to said first side so as to be inwardly swingable about the connected end from a position coplanar with said panels when the divider is in the flat position, to a swung position when the divider is in the erected position and, in which an end of said cross member abuts said second side panel; and (c) two tongue and mating receptacle combinations, the tongue and mating receptacle of one combination extending from respective abutting portions of said first side and second end panels, and the tongue and mating receptacle of the other combination extending from respective abutting portions of said cross member and said second side panels, so that the two combinations can retain abutting portions in engagement when the divider is in the erected position.

2. A container divider as described in claim 1 wherein said side panels are of equal length, and said end panels and said cross member are of equal length, said cross member is connected mid-way along said first side panel, and wherein each of said panels and said cross members when in respective swung positions, are orthogonal to respective connected panels.

3. A container divider as described in claim 2 wherein said side panels are twice the length of said end panel and said cross member.

4. A container divider as described in claim 3 additionally comprising:

(a) a pair of cross member extensions extending in coplanar relationship with said cross member from respective ends thereof, each equal in length thereto; and (b) a pair of second end panel extensions extending in coplanar relationship with said second end panel from respective ends thereof, each equal in length thereto;

all of the elements of the panel being cut in a unitary sheet.

5. A container divider comprising first and second lengthwise aligned sections of the same dimensions, cut on a unitary sheet, each section having:

(a) a first side panel, a first end panel, a second side panel, and a second end panel, said end panels being equal in length and said side panels being twice the length of said end panels, and being hingedly connected together end to end in the foregoing sequence to be inwardly swingable about connected ends from coplanar positions when the section is in a flat position, to respective swung positions when the section is in the erected position, defining an enclosed rectangle with lengthwise remote ends of said first side and second end panels abutting one another;

(b) a cross member equal in length to said end panels, with an upstanding end hingedly connected midway along said first side panel so as to be inwardly swingable about the connected end from a position coplanar with said panels when the section is in the flat position, to a swung position when the section is in the erected position, and in which an end of said cross member abuts said second side panel;

(c) a pair of cross member extensions extending in coplanar relationship with said cross member from respective ends thereof, each equal in length thereto; and (d) two tongue and mating receptacle combinations, the tongue and mating receptacle of one combination extending from respective abutting portions of said first side and second end panels, and the tongue and mating receptacle of the other combination extending from respective abutting portions of said cross member and said second side panel, so that the two combinations can retain abutting portions in engagement when the section is in the erected position;

ends of said first side panels of the sections remote from respective connected first end panels being connected together, and the divider also comprising one second end panel extension extending in coplanar relationship with one of said second end panels from an end thereof, and another second end panel extension extending in coplanar relationship from an opposite end of one of said second end panels, said extension being equal in length to said second end panels.

6. A divider as described in claim 5 additionally comprising a tab hingedly extending from a bottom of one of said panels so as to be swingable thereabout from a position coplanar therewith to a position orthogonal thereto.

7. A divider as described in claim 5 wherein said tab hingedly extends from a bottom of one of said second end panels.

8. A divider as described in claim 7 wherein only one of said sections has a second end panel with a second end panel extension extending from an end thereof remote from said second side panel, and wherein said tab extends from the second end panel of the other one of said sections.

9. A method of producing a plurality of equally dimensioned dividers, each as described in claim 8, comprising cutting pairs thereof in a unitary flat sheet, with the members of each pair being cut in lengthwise inverted relationship, with the bottom edge of the tab on each one of the pair being substantially lengthwise aligned with a bottom edge of a second end panel of the other one of the pair and extending lengthwise therebeyond.

* * * * *